US007314433B2

(12) United States Patent
Stout

(10) Patent No.: US 7,314,433 B2
(45) **Date of Patent: *Jan. 1, 2008**

(54) AQUATIC EXERCISE DEVICE

(75) Inventor: Tadlington A. Stout, Encinitas, CA (US)

(73) Assignee: Aqualogix, Inc., San Diego, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/213,016

(22) Filed: Aug. 26, 2005

(65) Prior Publication Data

US 2005/0282688 A1 Dec. 22, 2005

(51) Int. Cl.
*A63B 31/00* (2006.01)

(52) U.S. Cl. ..... 482/55; D21/678

(58) Field of Classification Search ..... 482/44, 482/49, 51, 55, 56, 108, 111, 132, 140, 142, 482/146–148, 121–130; 446/220; 441/56, 441/58, 136; D21/678
See application file for complete search history.

(56) References Cited

U.S. PATENT DOCUMENTS 3,809,397 A * 5/1974 Gruenewald ..... 473/457
4,468,023 A * 8/1984 Solloway ..... 482/10
4,632,387 A * 12/1986 Guzman ..... 482/111
4,819,951 A * 4/1989 Solloway ..... 482/111
5,033,739 A * 7/1991 MacKechnie ..... 482/111
D344,113 S * 2/1994 Shelton et al. ..... D21/678
6,955,633 B2 * 10/2005 Stout ..... 482/55

* cited by examiner

*Primary Examiner*—Lori Amerson
*Assistant Examiner*—Tam Nguyen
(74) *Attorney, Agent, or Firm*—Mintz, Levin, Cohn, Ferris, Glovsky and Popeo, P.C.

(57) ABSTRACT

An aquatic exercise device provides uniform resistance under water when moved in any direction while concurrently preventing erratic movements which can damage the wrist of the individual using it. The unique design featuring a plurality of orifices in spherical surface minimizes splashing and stirring the water around the user. The device is composed of two or more quadrants having a three sided spherical surface that is ringed by vertical ribs which effectively centralize the forces when moved laterally and work in unison when moved either forward or backward along the central axis. Each quadrant has a plurality of orifices that meter the water passing through the device which can be changed in size to yield an exerciser with more or less resistance. Optional attachable flanges provide for lessening or increasing resistance depending on the diameter of the flange legs and their overhang over the ribs.

10 Claims, 2 Drawing Sheets

AQUATIC EXERCISE DEVICE

RELATED APPLICATIONS

This application claims the benefit of U.S. patent application Ser. No. 10/657,906 entitled AQUATIC EXERCISE DEVICE filed on Sep. 9, 2003 which claims the benefit of U.S. patent application Ser. No. 10/044,552 entitled AQUATIC EXERCISE DEVICE filed on Jan. 12, 2002 which claims the benefit of U.S. Provisional Application No. 60/260,940 filed Jan. 12, 2001, each of which is incorporated by reference herein.

BACKGROUND OF THE INVENTION

The present invention relates to an exercise device used by individuals in water. More particularly, it relates to a new and unique hand-held aquatic exercise device which works equally well providing exercise to those inclined to stringent aggressive workout schedules as well as for those who need a gentle form of physical therapy. The device can be used singularly, being used in one hand at a time or in combination where two of the devices are used together and they will come in a variety of sizes.

Where many aquatic exercise devices use flotation as a resistance force, the device herein does not incorporate any means of flotation, thereby allowing that the individuals using it are not exerting themselves by trying to hold it under the water. The device herein provides an equal resistance in any direction during a workout, and is especially beneficial in a boxing style workout, because of the unique shape and the type of resistance in the pushing and pulling motions. A plurality of orifices in the spherical surfaces are designed to maintain a means for controlled release of the resistance pressure upon the device minimizing the stirring and splashing of the water in the individual's face when they are using it. The lightweight simple design also allows that it can be easily fabricated, shipped and stored. Another alternate preferred embodiment of the device provides for the incorporation of an additional resistance member attaching to the fins outer edge.

SUMMARY

The present invention accomplishes its desired objects by providing the Aquatic exerciser as a truly unique and versatile aquatic exercise device. This new device in a preferred embodiment will consist of a unitary spherical unit divided into two or more quadrants by fins that are substantially perpendicular to the tangent of the spherical surface. When used the device is held in the hand of the individual by the means of a handgrip and moved through the water. The handgrip may be in the shape of a pistol grip or a straight rod that is located within the inner spherical chamber formed by the outer quadrants.

Each quadrant is comprised of three fin-surfaces, two parallel to the central axis of the unit and one transverse to the central axis, all at equal angles and perpendicular to a tangent line on the spherical surface. The spherical surface of each quadrant has a plurality of orifices that provide a means to adjust the force and to stabilize the device as it moves through the water, and to minimize splashing and stirring of the water. These orifices in the spherical surfaces provide this means to adjust the force required to move the device through water by providing the metering of the water flowing through the device which concurrently helps control the stability. These orifices also allow the device to drain when removed from the water along with insuring that air is not entrapped within the inner spherical chamber when in use.

The device in the current preferred embodiment will be available with different sizes of orifices and fins, for varying degrees of resistance in the water, without deviating from the scope of the patent. In this fashion, the device could be provided in a singular fashion with one size orifice and fins or as a kit with differing sized orifices and fins combining to yield different resistance when forced through the water. Without the plurality of orifices in the spherical surfaces, the device would be unstable making erratic movements and tend to go to the line of least resistance or the weakest angle of pressure on a persons wrist. This uncertain erratic action can seriously damage the wrist of the individual using this or any other device. Thus, the orifices provide a means to stabilize the device during movement through the water.

All of the three fin surfaces are angled similarly with relation to the spherical surface as a means of concentrating the resistive force on the axis of each quadrant when moved in a lateral direction. When the device is pushed parallel to the central axis, the quadrants work in combination for a balanced means of resistance thereby minimizing twisting and providing a smooth flow of the device when used. With the inherent angle of the joined transverse fin surfaces of the quadrants, forming the back periphery of the device, a funnel is created as a means to channel the water into the inner spherical chamber to be metered out through the plurality of orifices when the device is pulled through the water. This unique and very inventive channeling of forces along varying axes, coupled with metering the passage of water through the device, creates an extremely stable, yet light weight aquatic exercise device.

An alternate preferred embodiment of the aquatic exerciser will have each quadrant as a separate identical piece, to be attached together by any one of a number of conventional means of attachment including one or a combination of snapping together, glue or fasteners. By making the quadrants as separate substantially identical pieces, a great deal can be saved in molding costs. Also, savings will be made in shipping the unit disassembled in a smaller box to be assembled by the individual purchasing the device. The handgrip will be inserted at assembly by a means of attachment such a threaded rod, a nut and washer at each end, cooperative frictional engagement or similar means of attachment. With this unique method of mounting of the handgrip through a plurality of mounting holes, the angle of the handgrip within the inner spherical chamber can be adjusted for the comfort of the individual using the device. This unique method of assembly does not deviate from the intended scope of the patent on the herein disclosed aquatic exerciser device in any way.

An additional preferred embodiment of the aquatic exerciser device will have a mountable flange member configured for registered engagement with the ribs on the assembled unit and mounted to the device with a central alignment member using a means of attachment such as conventional fasteners on the ends of each flange member. This flange member will increase the resistive force in each quadrant of the device by trapping the water against the outer spherical surface and thereby provide a means of adjustment of forward and rearward resistive force. As can be seen, a kit of the flanges could be provided in various sizes to provide further means to adjust the forward and rearward resistive force.

An object of this invention is to create a device that works equally well for an aggressive workout as it does for physical therapy.

Another object of this invention is to create a device that has equal and uniform resistance in any direction that it is thrust.

An additional object of this invention is to create a device that is stable when it is thrust in any direction, not making erratic movements, trying to seek the path of least resistance. Another object of this invention is to create a device that has a cushion to the resistance, by metering the passage of the water through the device.

Still another object of this invention is to create a device that is lightweight and can be easily shipped or stored.

A still further object of the invention is to create a device that does not create a great deal of splashing in the face of the individual using it. These together with other objects and advantages will become subsequently apparent reside in the details of the construction and operation as more fully hereinafter described and claimed, reference being had to the accompanying drawings forming a part hereof, wherein like numerals refer to like parts throughout.

BRIEF DESCRIPTION OF THE DRAWINGS

The accompanying drawings, which are incorporated in and form a part of this specification, illustrate embodiments of the invention and together with the description, serve to explain the principles of the invention.

DETAILED DESCRIPTION

Figure 1:
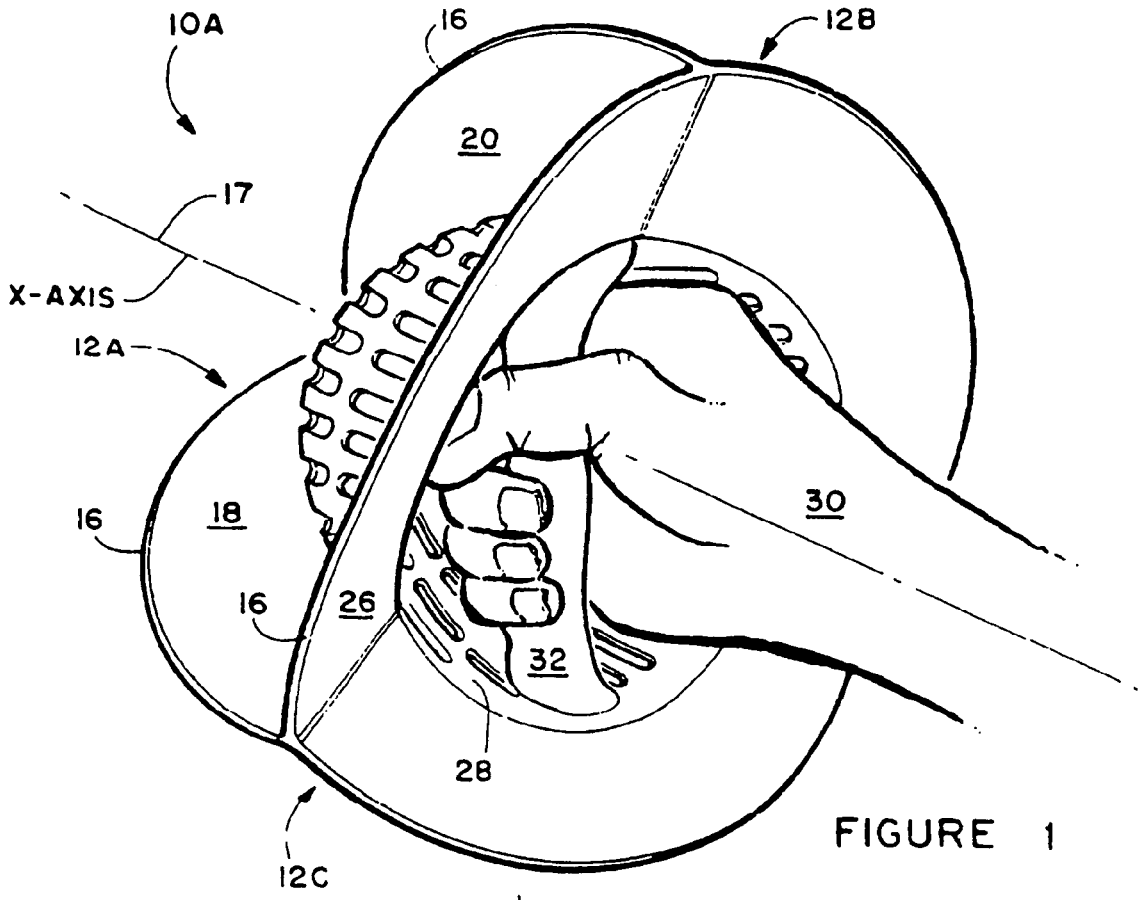
FIG. 1 depicts a perspective view of the aquatic exerciser device from the rear with an individual user's hand holding the handgrip attached to the interior surface of the bell.
Figure 2:
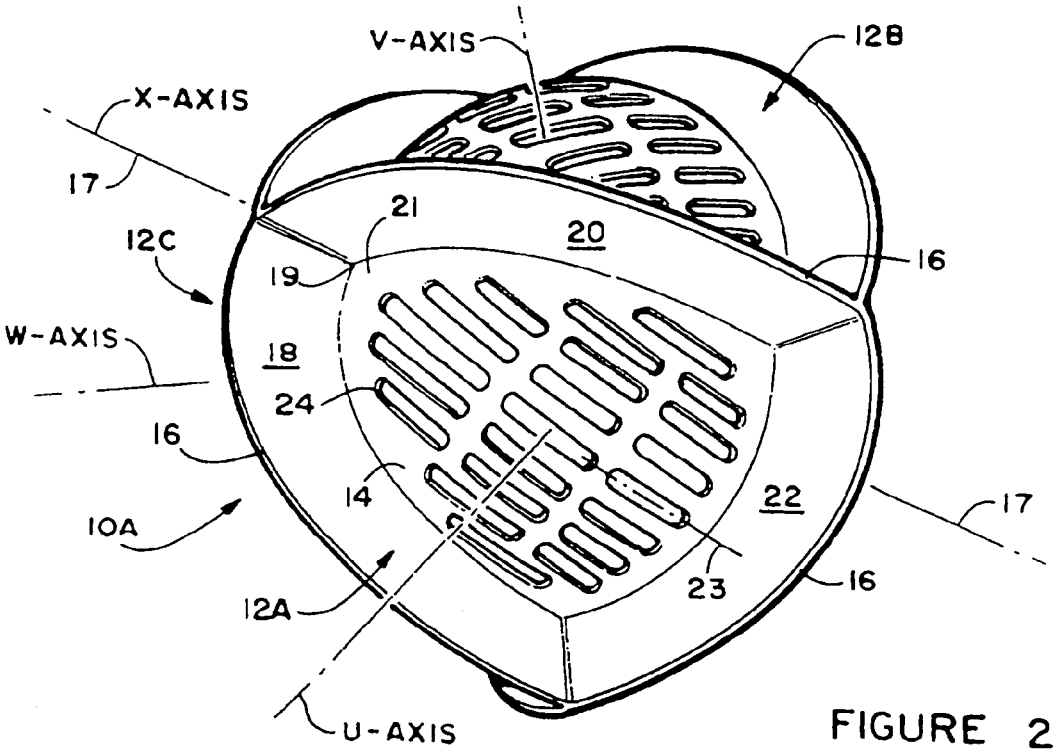
FIG. 2 depicts a perspective view of the aquatic exerciser.

FIG. 1 is an illustration of a perspective view from the backside of a bell device 10A. The device 10A is shown in it's preferred embodiment of three quadrants, 12A, 12B and 12C, although it must be understood that it can be constructed in any number of quadrants, from two or more without deviating from the scope of this patent. Quadrant 12A, being a typical quadrant illustrated in FIG. 2, consists of an outer spherical surface 14 enclosed by three fins 16 all perpendicular to a tangent line on spherical surface 14. These fins 16 may vary in size on different units and still be within the scope of the patent. Two of the fins 16 on the device 10A are parallel to the central axis or X-axis with fin surfaces 18 and 20 facing inwardly into quadrant 12A and with one fin 16 transverse to the X-axis with fin surface 22 facing inwardly, all fin surfaces 18, 20 and 22 at equal angles to the spherical surface 14. Each quadrant 12A, 12B and 12C will have a line of axial force as represented by U-axis, V-axis and W-axis. When the device 10A is laterally thrust through the water, the angle of the fins 16 results in a pressure on the three fin surfaces 18-22 directed along the U, V, and W axes. When the device 10A is thrust forward, parallel to the central axis or X-axis, the quadrants 12A, 12B and 12C work in combination to produce a balanced means of resistance and thereby minimize twisting force.

The spherical surface 14 of each quadrant 12A has a plurality of orifices 24 that are used to cushion the force and stabilize the aquatic exercise device 10A as it moves through the water. The sizes and shapes of the orifices 24 may vary with different units and still be within the scope of the patent. In the current best mode, the orifices 24 are elongated along a central axis 23 through each of the orifices 24. Each orifice central axis 23 points toward an axis point 19 on the exterior surface 21 of the bell, where the axis point 19 is formed at the intersection of the x axis 17 and the exterior surface 21. Water vents through the arrangement of orifices 24 to stabilize the device 10 during use and minimize twisting when the device 10 is moved back and forth along the x axis 17 underwater by the user.

The inherent angle of the transverse fin surface 22 of fin 16, with the back side 26, is used in combination with those of the other quadrants 12B and 12C, forming the back periphery of the device 10, thus creating a funnel as a means to channel the water into the inner spherical chamber 28 to be metered out through the plurality of orifices 24 in the spherical surface 14 for means of resistance, when the device is pulled back through the water. Of course changing the size of the orifices 24 provides a means of adjustment of the resistance provided when the device is pushed or pulled through the water so providing devices 10 with different sized orifices 24 in a kit form would allow the user to adjust the resistance to a desired level by choosing the device 10 with the appropriate sized orifices.

When used, the aquatic exercise device 10A is held in the hand 30 of the individual by the means of handgrip 32. The handgrip 32 may be in the shape of a pistol grip or a straight rod that is located within the inner spherical chamber 28 formed by the quadrants 12A, 12B and 12C.

Figure 3:
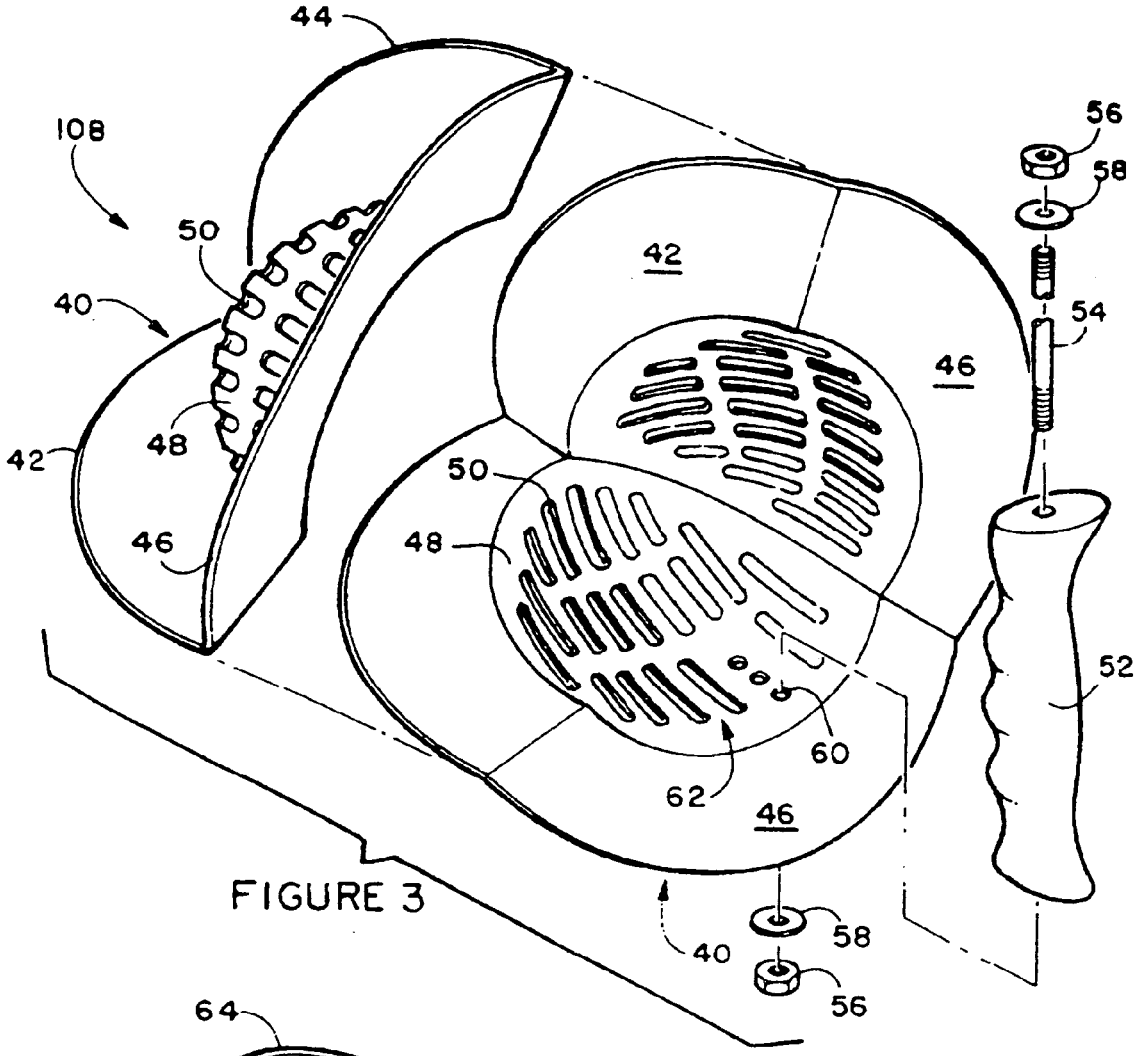
FIG. 3 depicts a perspective exploded view of the device with the bell formed with each quadrant being a separate piece, showing one quadrant removed with the handle and mounting hardware.
Figure 4:
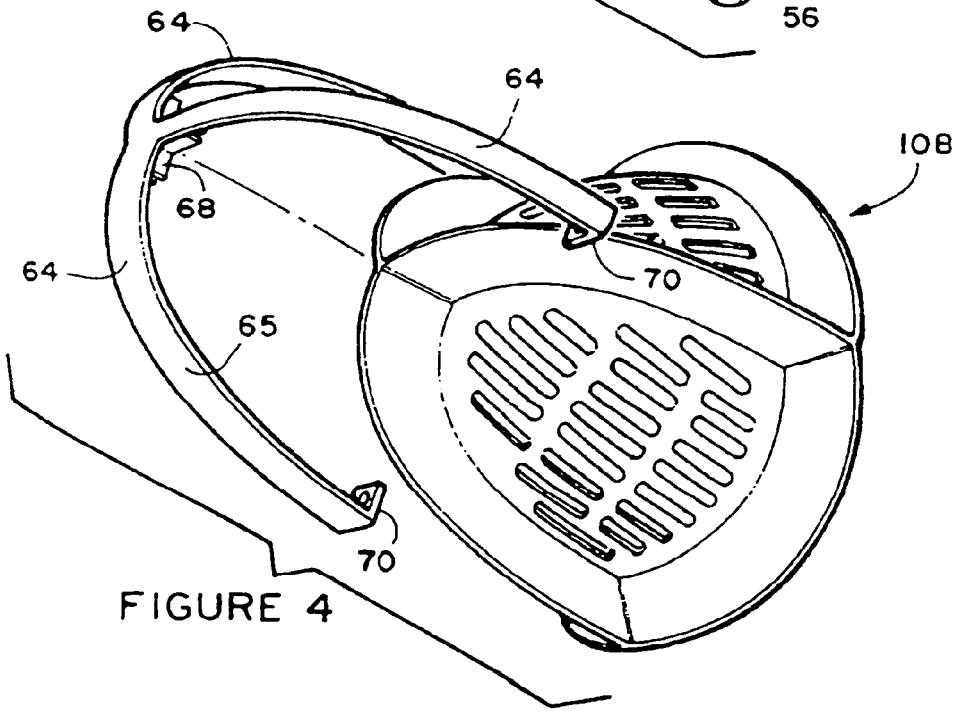
FIG. 4 is an illustration of a perspective view of an exemplary aquatic exercise device having a flange member.

An alternate embodiment illustrated in FIG. 3, of the aquatic exercise device 10B having quadrants 40 as separate identical pieces, to be attached together by any one of a number of conventional attachment means, as in snapping together, glue or fasteners. Each quadrant 40 will be comprised of three separate fins 42, 44 and 46 with a spherical surface 48 having a plurality of orifices 50. The handgrip 52 will be removably attached means of attachment to one of a plurality of attachment points as depicted with threaded rod 54, nut 56 and washer 58 at each end of the rod 54. With this unique method of mounting of the handgrip through a plurality of mounting holes 60, the angle of the handgrip within the inner spherical chamber 62 can be adjusted for the comfort of the individual using the device.

Another alternate embodiment of the aquatic device 10A and 10B Will have a flange member 64 configured to match the number of fins 16 on the assembled unit and mounted to the device with a central alignment member 68 and means of attachment such as conventional fasteners on the ends of each flange member 70. This embodiment provides a means to vary the forward and rearward resistance of the device when moved through water. When attached the flange member 64 would impart more resistance and the flange 64 when provided in kit form featuring a plurality of flange members 64 with varied sized diameters 65 which would overhang the ribs 16 and thereby provide variable resistance depending on the diameter.

Therefore, the aquatic exercise device 10, includes at least a plurality of fins 16 arranged to form a bell and handgrip 32 (handle) connected within the bell. The plurality of fins include at least one transverse fin 16 that at least partially encircles the inner cavity 28 of the bell and a plurality of longitudinal fins 16 extending from the axis point 19 (apex) to the transverse fin 16 having a transverse fin surface 22.

The bell may also have a spherical surface 14 positioned between the longitudinal fins 16, where the spherical surface 14 includes several orifices (apertures) 24 allowing water to vent into or from the inner cavity when the device is moved through water. By symmetrically arranging and sizing the fins 16 and apertures 24, a resistance can be produced when the device 10 is moved through water where the resistance is independent to the direction the device 10 is moved in a plane tangential to the axis point 19 (apex).

While the present invention has been described herein with reference to particular embodiments thereof, a latitude of modification, various changes and substitutions are intended in the foregoing disclosure, and it will be appreciated that in some instance some features of the invention will be employed without a corresponding use of other features without departing from the scope of the invention as set forth.

What is claimed is:

1. An aquatic exercise device comprising:

a plurality of fins connected and arranged to form a bell having an inner cavity, the plurality of fins comprising:

a plurality of equally spaced longitudinal fins partially defining the inner cavity of the aquatic exercise device; and a plurality of curved transverse fins connected transversely to at least two of the plurality of equally spaced longitudinal fins, each of the plurality of curved transverse fins at least partially encircling—the inner cavity; and a handgrip connected to at least one of the plurality of fins and accessible by a human hand through an opening to the inner cavity.

2. An aquatic exercise device in accordance with claim 1, wherein the handle is connected within the inner cavity.

3. An aquatic exercise device in accordance with claim 1, further comprising a bell surface connected between the plurality of equally spaced longitudinal fins.

4. An aquatic exercise device in accordance with claim 1, wherein the curved transverse fins at least partially encircle the inner cavity perpendicularly to at least one of the plurality of longitudinal fins.

5. An aquatic exercise device comprising:

a plurality of equally spaced longitudinal fins connected and arranged to form a bell having an inner cavity;

at least one transverse fin connected to at least one of the plurality of equally spaced longitudinal fins and at least partially encircling the inner cavity; and a handle connected to at least one of the plurality of tins and accessible by a human hand through an opening to the inner cavity, the handle oriented transversely to at least one of the plurality of fins.

6. An aquatic exercise device in accordance with claim 5, wherein the handle is connected within the inner cavity.

7. An aquatic, exercise device in accordance with claim 5, wherein the handle comprises a handgrip.

8. An aquatic exercise device in accordance with claim 5, further comprising at least one other curved transverse fin.

9. An aquatic exercise device in accordance with claim 5, further comprising a bell surface connected between the equally spaced longitudinal fins.

10. An aquatic exercise device comprising:

a plurality of fins connected and arranged to form a bell having an inner cavity, the plurality of fins comprising:

a plurality of equally spaced longitudinal fins partially defining the inner cavity of the aquatic exercise device; and a plurality of curved transverse fins, each at least partially encircling the inner cavity and comprising:

a first curved transverse fin connected transversely to at least two of the plurality of equally spaced longitudinal fins, and a second curved transverse fin connected transversely to at least one of the plurality of equally spaced longitudinal fins; and a handgrip connected to at least one of the plurality of fins and accessible by a human hand through an opening to the inner cavity.

* * * * *